US005603461A

United States Patent [19]

Galbreath

[11] Patent Number: 5,603,461

[45] Date of Patent: Feb. 18, 1997

[54] FULLY AUTOMATIC BOBBIN WINDING MACHINE

[76] Inventor: Louise Galbreath, 6499 Hwy 137, Valley Head, Ala. 35989

[21] Appl. No.: 415,933

[22] Filed: Apr. 3, 1995

[51] Int. Cl.[6] ..... B65H 54/00; B65H 67/044

[52] U.S. Cl. ..... 242/18 A; 242/25 A; 242/41

[58] Field of Search ..... 242/18 A, 25 A, 242/41

[56] References Cited

U.S. PATENT DOCUMENTS

| | | | |
|---|---|---|---|
| 1,481,243 | 1/1924 | Snyder et al. . | |
| 1,483,937 | 2/1924 | Haüssler | 242/18 |
| 1,499,925 | 7/1924 | Herr | 242/18 |
| 1,516,648 | 11/1924 | Schweiter | 242/18 |
| 1,865,075 | 6/1928 | Boving | 242/18 |
| 2,811,317 | 10/1957 | Herbert et al. | 242/18 |
| 2,811,319 | 10/1957 | Bakker | 242/18 |

*Primary Examiner*—William Stryjewski

[57] ABSTRACT

Fully Automatic Bobbin Winder so designed as to fully automatically wind thread continuously from one bobbin to the next bobbin at high speed. The winding operation never stopping during any of the steps of the automatic operation of wound bobbin being ejected from spindle (1) and an empty bobbin being fed to spindle (1) from a shute and loader (20). The spindles are driven by a main shaft (21) connected to a power source. Spindles are housed in a turret or rotating head (8). Turn of rotating head, movement forward and reverse of spindles for loading and ejecting bobbins and other moving parts are controlled by a cammed timer (16).

2 Claims, 8 Drawing Sheets

FULLY AUTOMATIC BOBBIN WINDING MACHINE

FIELD OF THE INVENTION

This invention relates to the winding of sewing machine disposable "Prewound Bobbins" used in the sewing trades as the bottom thread of a lock stitch produced by lock stitch sewing machines.

PRIOR ART

Presently and since 1923 with the Snyder U.S. Pat. No. 1,481,243 assigned to a large thread co. the sewing machine disposable "Prewound Bobbin" market has been a controlled market.

The Snyder patented bobbin being a miniature cross wound mass of thread, wound on a tubular core by conventional tube or so called bobbin winding machines, thereafter a paper flange is pressed against the ends of the core and the core and the mass of thread thereon.

Prior patents of so called "Bobbin Winding Machines" have no relationship with my invention as they are machines for winding very large tubes of yarn for supply purposes or what is called feeder yarn in the trade.

SUMMARY OF THE INVENTION

My invention relates to a new, useful, improved, fully automatic, continuously winding, bobbin winding machine for winding disposable "Prewound Bobbins" and particularly to means for transmitting oscillatory and rotary motion to the spindles and rotary motion to the turret housing the spindles, also using opening and closing power mechanisms or devices for moving parts such as micro switches, solenoids, air cylinders or other power devices.

Another object of the invention is to provide a small, light weight, very economical to operate, continuously winding, loading and ejecting while winding, at constant high speed, fully automatic bobbin winding machine.

The construction is about the size of a sewing machine head mounted singularly or it can be mounted in gang formation upon a structure of desired size. The winding, loading and ejecting of bobbins being consumated within the programmed winding cycle.

This invention is smaller and much faster than other bobbin winders used in the trade.

This machine can be adjusted in a few minutes to wind various yardage counts for various size threads, also various styles of bobbins. This machine can also be adjusted in a few minutes to wind larger or smaller bobbins by changing the collars and cup to hold the desired size of bobbin.

This invention can also be used to wind small spools, cops and the like. Said machine constructed in a larger version can wind large flanged bobbins.

This invention relates to a fully automatic winding machine having a turret or rotating head with spindles incarcerated within its shaft housing to wind, load and eject bobbins as programmed by a cammed timer, programmer or computer software.

This invention produces a machine for winding bobbins one after another without stopping the rotation speed of its spindles and main shaft or its operations.

This invention produces a winding machine of very simple design with easily replaceable parts, has higher efficiency than winding machines now known in trade, thus reducing the overall cost of construction of machine and production of bobbins.

This machine, to attain high speed in operation, provides a moveable, rotating turret with rotating driving means housed within and thereon with new and improved organization of the rotating driving means in which each of the separable rotary driven spindles is positively and continuously driven without interruption of their rotation while a bobbin is winding, a filled bobbin is being discharged from spindle and an empty bobbin placed on spindle.

This invention, to attain high speed as well as reliability in operation, provides devices insuring a substantially, simultaneous tainous parting of the thread between the filled bobbin and the empty bobbin and gripping of the thread between the empty bobbin and a displacable and replaceable collar on the spindle driving shaft at the commencement of the winding operation or cycle.

This invention will reduce care and attention required by an operator. It provides a magazine or hopper feed which handles and meters one bobbin at a time, without jamming or chocking and constant consequent interruption of successive winding operations. This invention uses vibration of winding machine as means to agitate bobbins sufficiently to keep them moving down into the metering device, one bobbin at a time as the predetermined programming indicates.

This invention comprises spindles within a turret housing, said spindles are moveable or shiftable axially to receive empty bobbins and to release wound bobbins, said spindles are driven continuously and positively by power/energy means.

The turret with spindles therein resides on the main shaft of the machine from which spindles are driven positively and operate independently.

A number of timing cams are connected and from these cams a metering mechanism, a thread severing mechanism, an empty bobbin onto spindle and filled bobbin ejected are operated in proper sequence to discharge a filled bobbin from spindle and to load an empty bobbin onto spindle without stopping the rotation of spindles and the main shaft.

When this bobbin winding machine is in operation and thread is being wound upon an empty bobbin and the accumulated thread is of the desired preset yards, predetermined by suitable adjustment devices known in the trade, the thread is cut or broken and the ejected wound bobbin rolls across the surface of machine keeping the thread end in close proximity to the mass of thread, thus keeping the end of thread from unwinding as it rolls into a container.

OPERATION OF INVENTION

Figure 1:
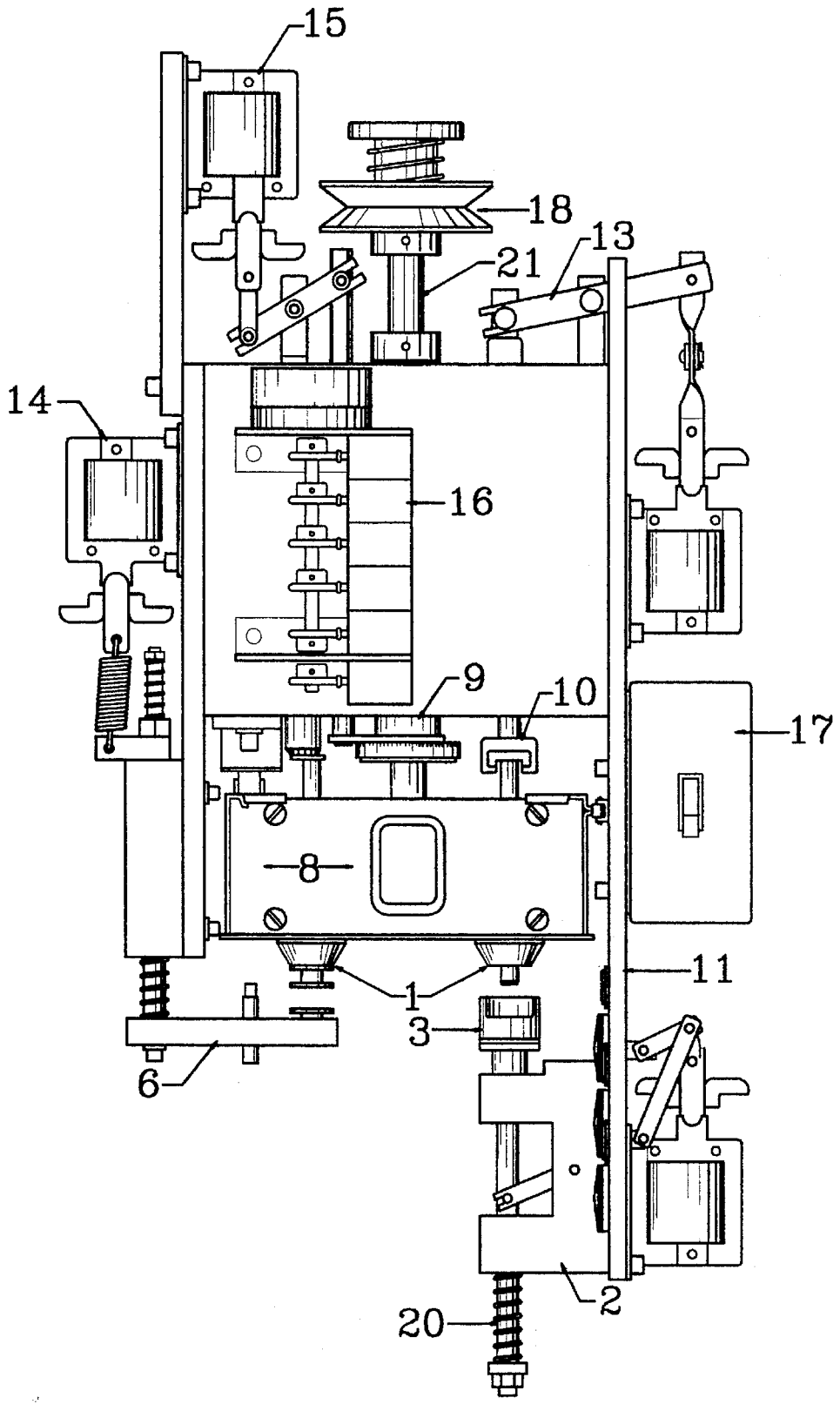
FIG. 1 is a side view of the instant invention.
Figure 2:
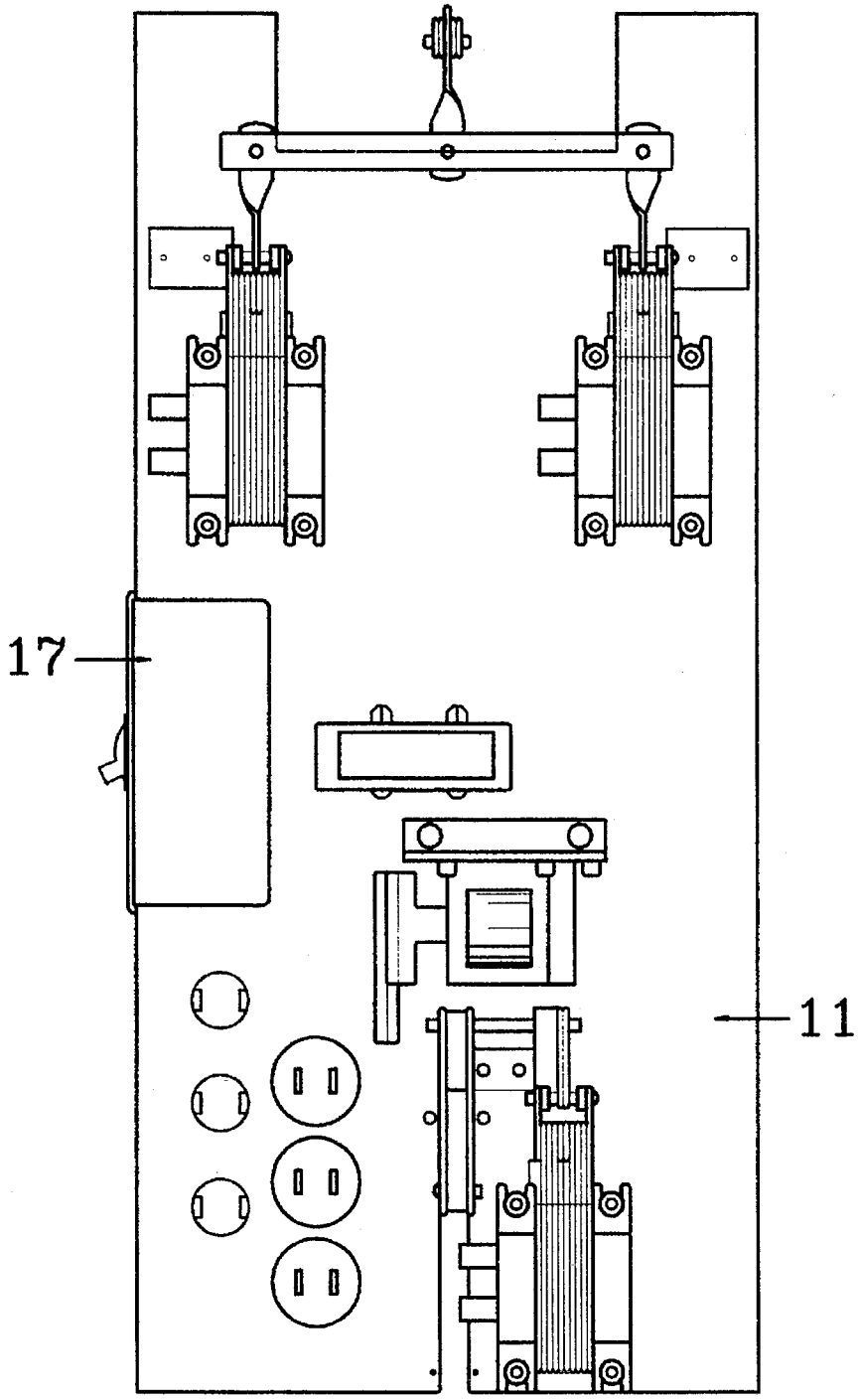
FIG. 2 is the under side of the instant invention.
Figure 3:
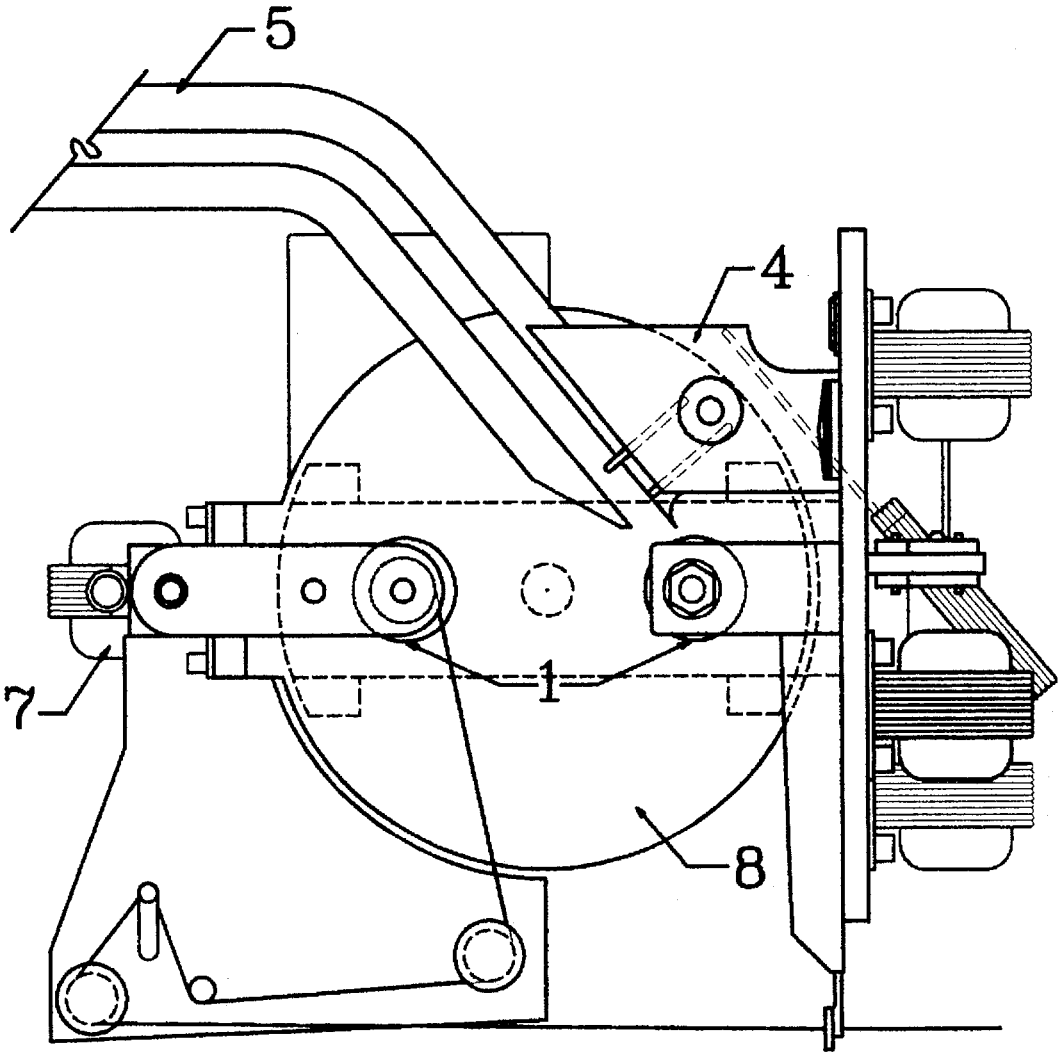
FIG. 3 is the front view of the instant invention.

The following is a description of operation of my invention. Reference being had to the accompanying drawings FIG. 1 and FIG. 2.

To start the winding process, begin with proper threading of thread from thread supply over any stop motion device and tensioning device known in the trade, by placing a bobbin upon end of the top spindle (1) with thread behind bobbin, then push the bobbin against the slightly recessed collar Of spindle (1) to hold the thread securely, depressing a reset button or switch will bring the calmed timer or programmer shaft into start of cycle position and it stops. Turn on the main switch (17). A cam of timer or programmer (16) activates a device (14) on top of machine which closes idler arm (6)against bobbin on the top spindle of the turret. The spindles have a furcated device, which grips the bobbin to keep the bobbin from turning on the spindle. The thread is then gripped between bobbin flange and the recessed collar 3° or bobbin holder, which is secured to its shaft and is turning continuously, simultaneously the thread of previously wound bobbin upon the lower spindle is severed, broken or cut by the idler arm (6) closing against the bobbin. A timer cam (16) then activates the ejector (13) switch which ejects the wound bobbin from spindle by causing the spindle to reverse into the turret housing, thereafter moving forward to catch the next bobbin which is simultaneously metered into the loader cup (3) which is then power activated to move forward to push empty bobbin onto lower spindle, at a predetermined time. All of this is programmed, controlled by the cammed timer, or controlled by computer software. The winding bobbin at the top position gets its full wind of thread and another power device operates the turret release and the clutch or other means of turning the turret is spinned to the continuously turning shaft and turns the turret its programmed turn, placing the upper spindle with wound bobbin into the lower position for bobbin ejection and places the lower spindle with empty bobbin thereon at the upper position for being wound. Thread feeds continuously from one bobbin to the next automatically placed behind the bobbin in the upper position when lower bobbin thread is severed, cut or broken. This programmed turn of turret is accomplished by a lower power drive or other means of movement activation, positioning the yoke (10) to grip the flanged end of spindle in the lower position. The cycle then begins again by idler arm (6) pressing the upper spindle with bobbin"home" which also cuts or breaks the thread between the upper empty bobbin and the lower wound bobbin as thread begins winding on the upper bobbin.

Incorporated into the mechanism are several overriding safety switches (11) for instance, when the turret makes its programmed turn, it automatically closes a switch operating the turret turning device or clutch or power device and when turret completes its turn it hits a switch which releases the power device. Another device causing the turret to be released so that it can be turned by hand as needed for cleaning the machine. When the winding cycle is completed and the next winding cycle will start over at the beginning of cycle as described in the foregoing. This is a never ending process until the main power switch is turned off.

Figure 4:
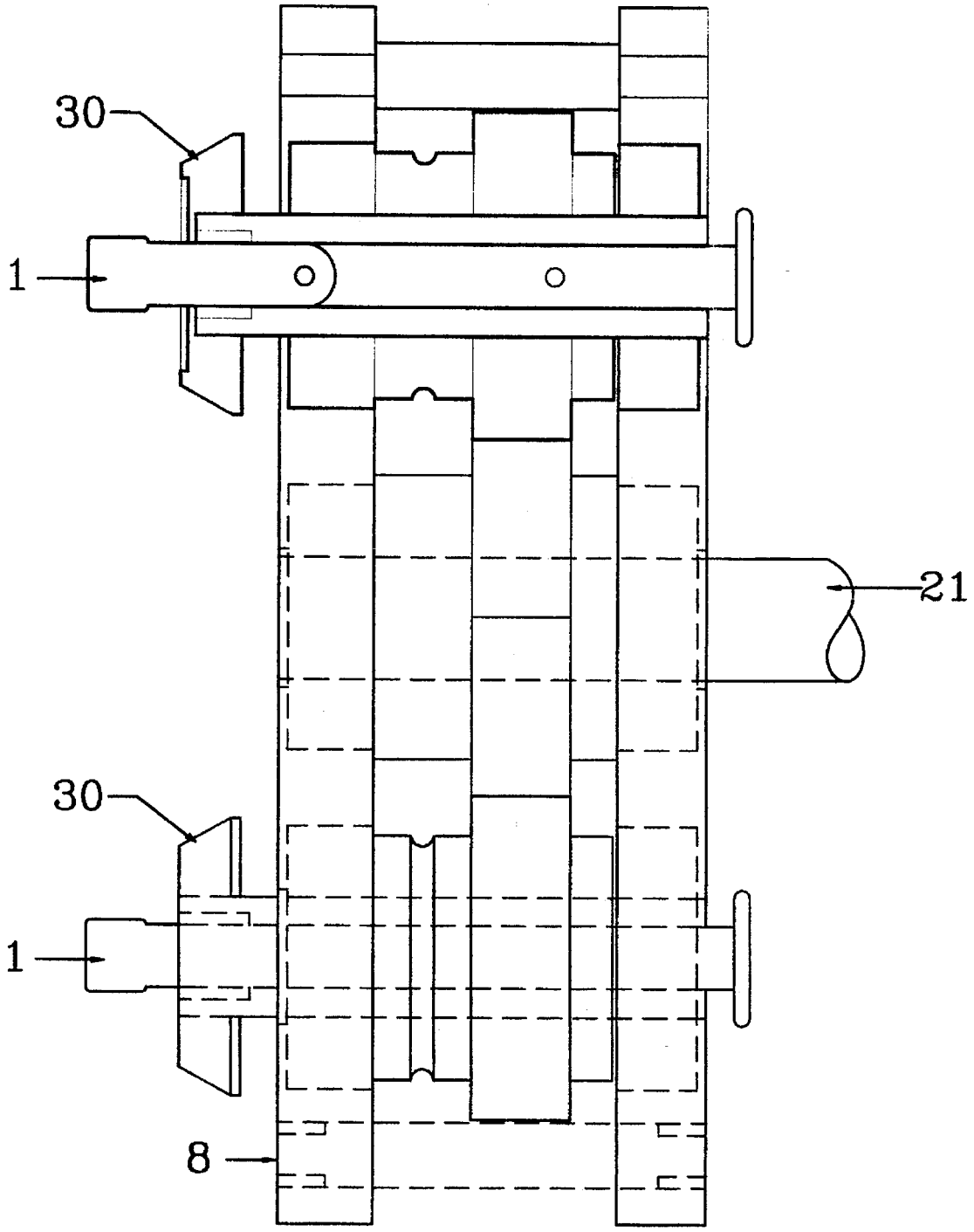
FIG. 4 is an cut away view of the turret and spindle drive system.

FIG. 4 shows the main shaft 21 connecting to turret 8 in which is controllably coupled. FIG. 4 also shows the transmission that connects the mains shaft 21 with spindles for continuous drive.

Figure 5:
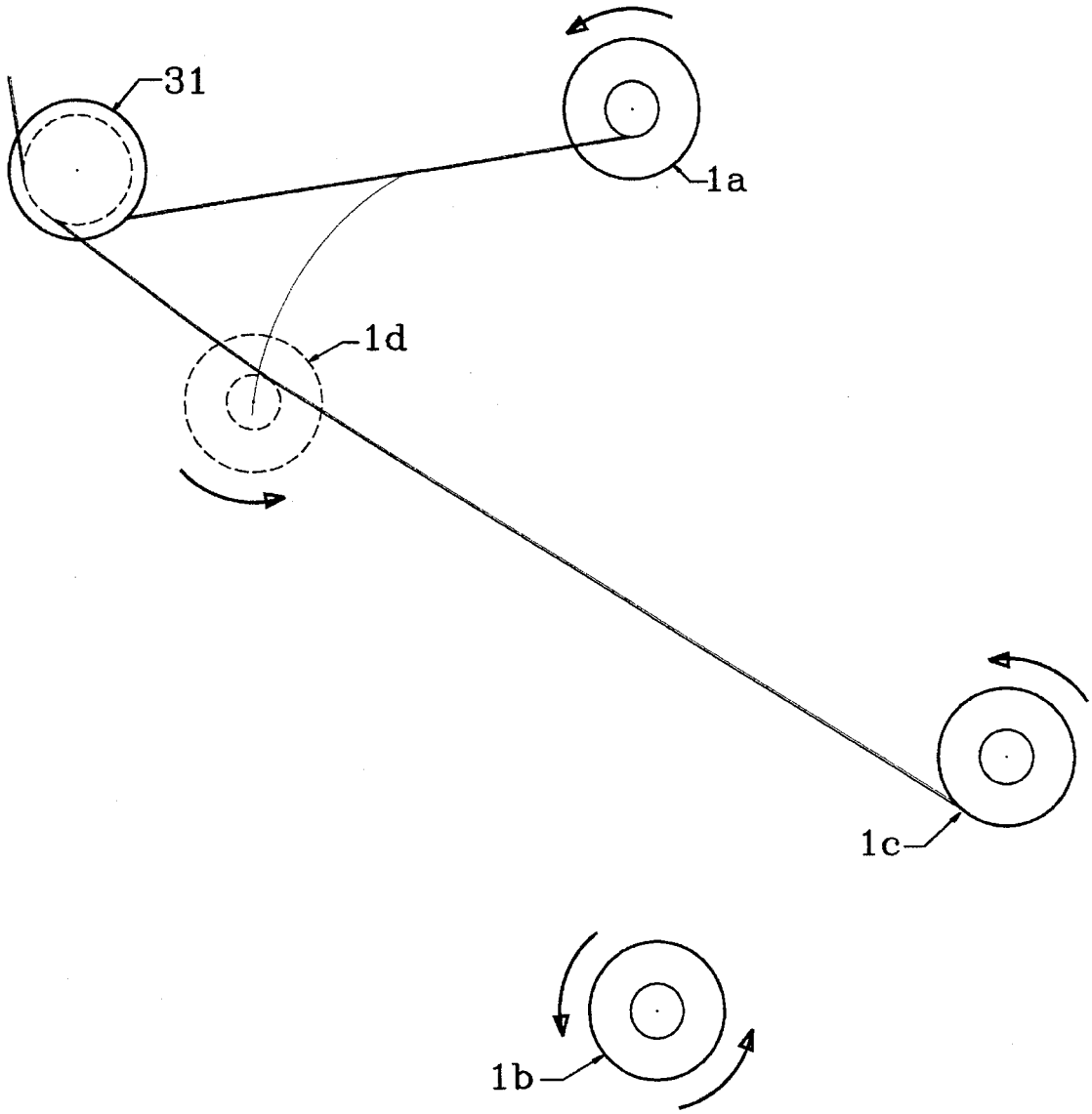
FIG. 5 is a diagrammatic view of the movement of the spindle during change over from a full bobbin to an empty bobbin.

FIG. 5 shows the bobbin change over in which spindle 1*a* is winding in the upper position wherein thread is guided by thread guide 31 and spindle 1*b* is doffing a full bobbin and donning a new bobbin. Then spindle 1*a* rotated in direction X via the movement of turret and 1*a* spindle goes to the position of spindle 1*c* which is continuing to wind up and spindle 1*d* moves to the position where spindle 1*c* occupies and engages the thread.

Figure 6:
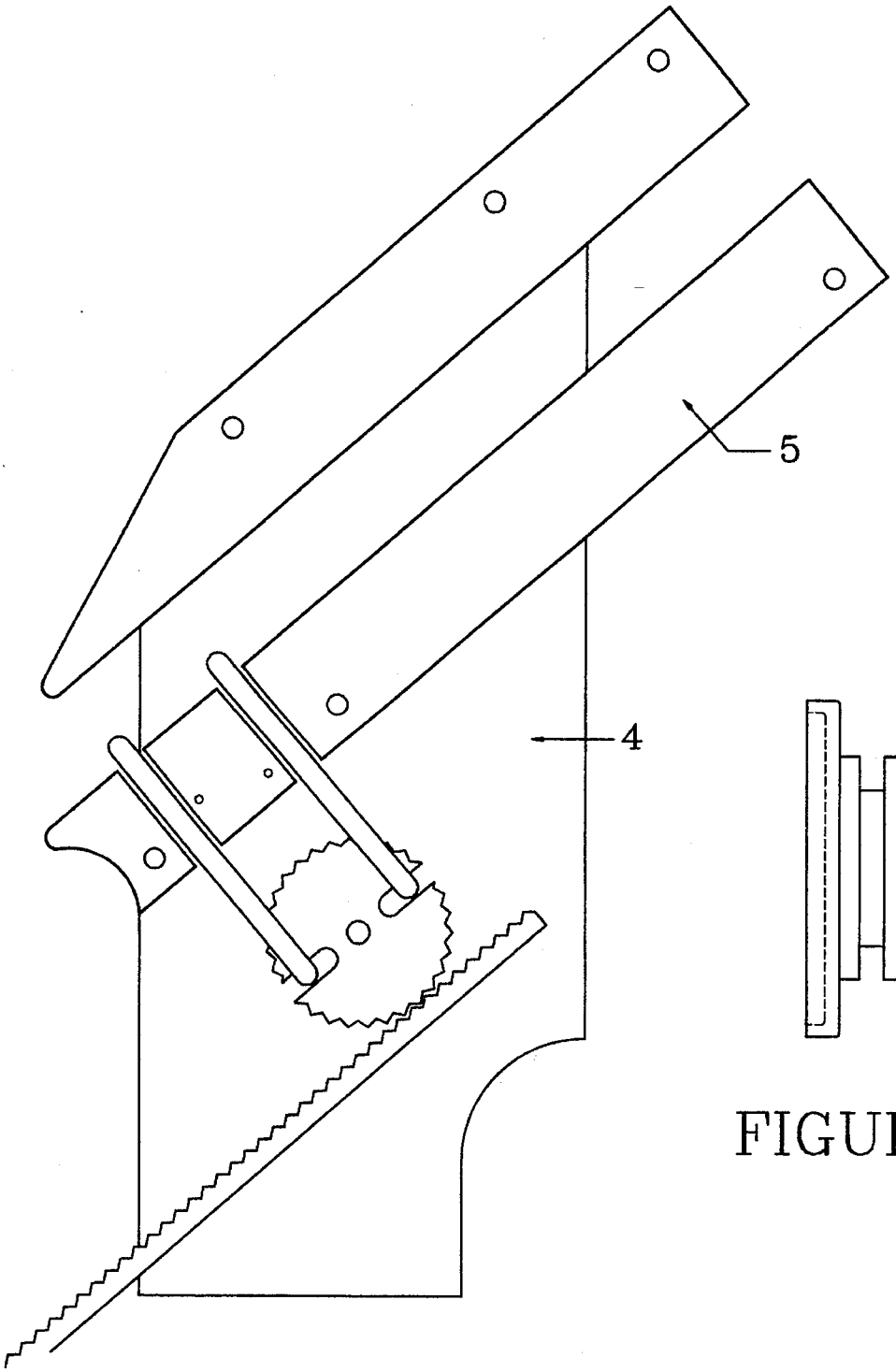
FIG. 6 hows the metering device.
Figure 8:
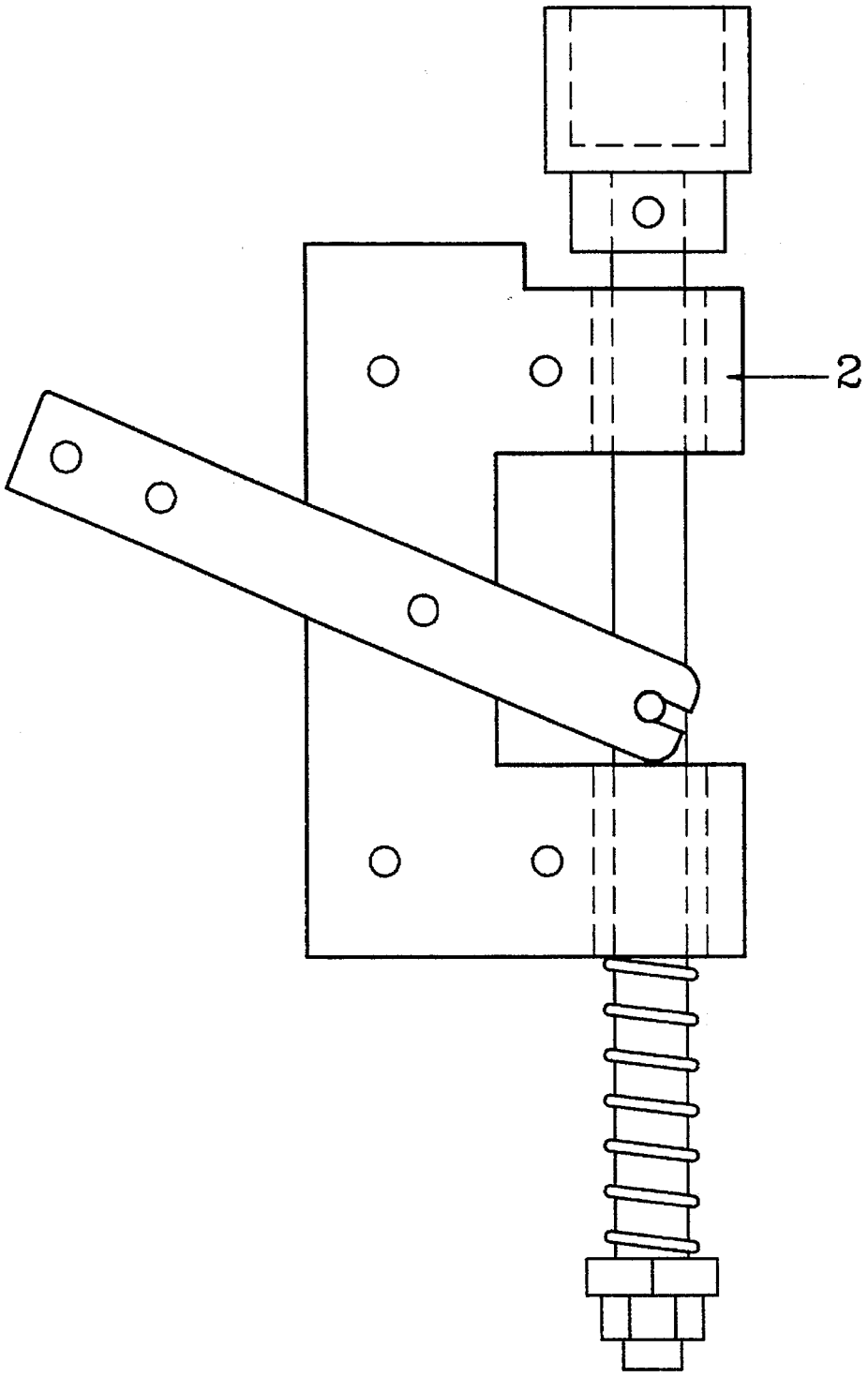
FIG. 8 hows the loader mechanism.

FIG. 6 and 8 show the chute 5 which bobbin go down to bobbin metering mechanism 4 for the loader 2 to load a new bobbin to spindle 1 and cup/bobbin holder 3 while the other spindle winds up a thread.

Figure 7:
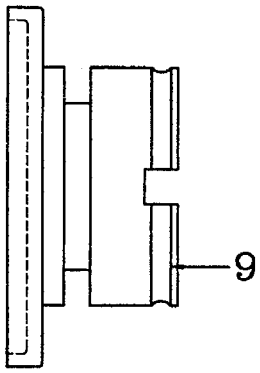
FIG. 7 shows the clutch mechanism.

FIG. 7 shows clutch which engages and disengages the main shaft 21 with turret 8 for controllably rotating the spindles to positions.

Figure 9:
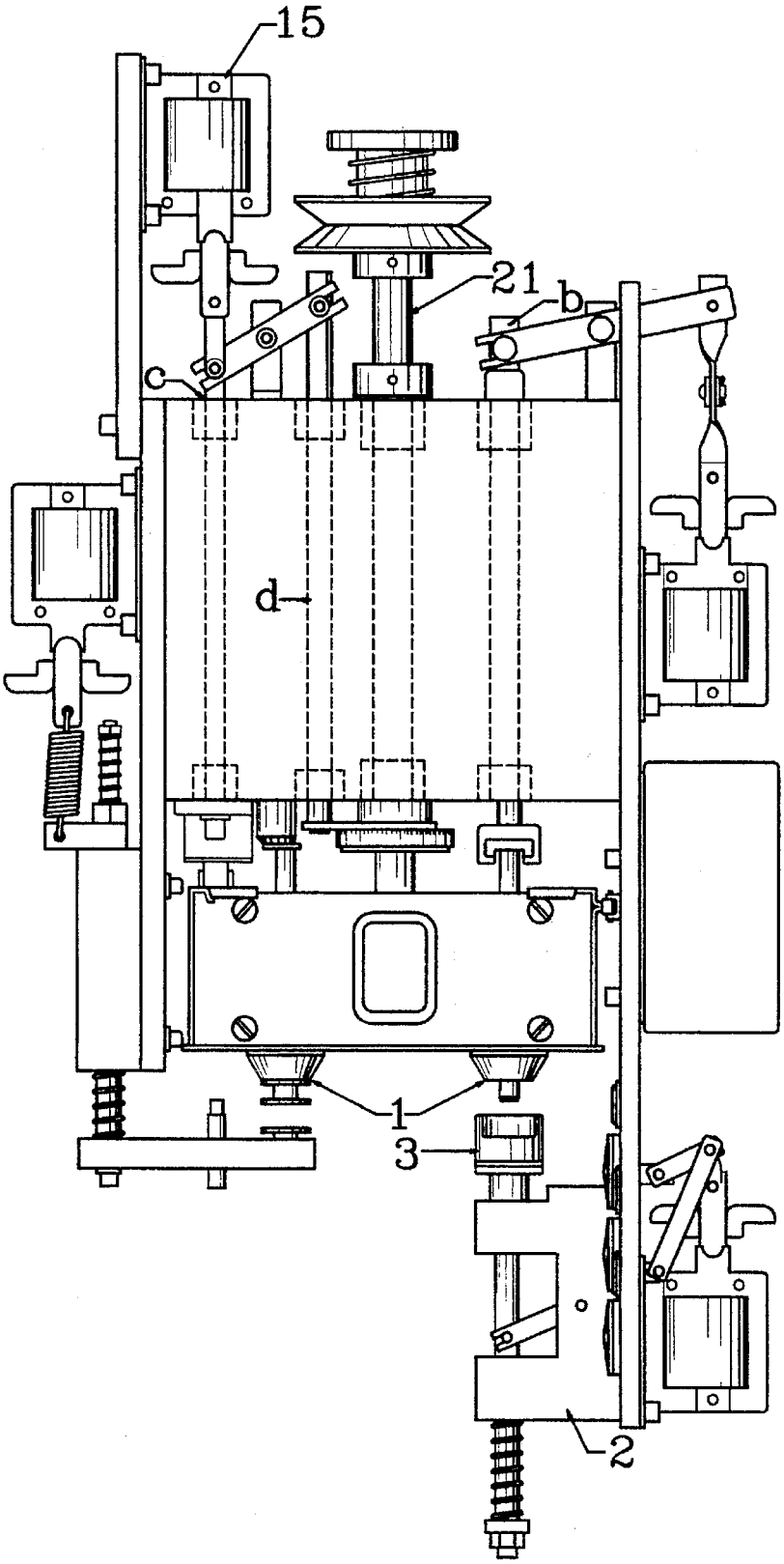
FIG. 9 As a side cut away view of the instant invention.

FIG. 9 shows the apparatus with main shaft 21 which rotates the turret 8 in a controllably coupled manner by clutch shaft d and the mains shaft 21 is connected to the spindles 1 for continuous drive. Ejector shaft b is used for ejecting new bobbins at the lower position. Turret pen shaft c is used to engage and disengage the turret in a predetermined position and hold the turret steady during operation.

PARTS TO WINDING MACHINE (1) Collars and spindles
(2) Loader
(3) Cup or bobbin holder
(4) Bobbin metering mechanism
(5) Bobbin shute
(6) Idler and Idler arm
(7) Level wind adjuster
(8) Turret
(9) Clutch or other means of turning turret.
(10) Yoke
(11) Safety release buttons
(12) Spindle stop
(13) Bobbin ejector shaft
(14) Solenoid or pneumatic cylinder or other mechanical-electrical movement device.
(15) Solenoid or pneumatic cylinder or other mechanical electrical movement device.
(16) Timer or programmer or computer software
(17) Main power switch
(18) Means of rotation of main shaft
(19) Turret pen or turret holder
(20) Loader shaft
(21) Main shaft

PREFERRED EMBODIMENT

The preferred embodiment of this fully automatic bobbin winding machine as described in the foregoing is with the opening and closing devices for moving parts being micro switches and solenoid and the programmer being a cammed timer.

In as much as the present invention is subject to many variations, modifications and changes in detail, it is intended that all matter described above or shown in the accompanying drawings be interpreted as illustrative and not in a limiting sense.

I claim:

1. A fully automatic bobbin winding machine for continuously ejecting a full bobbin from a spindle and loading a new bobbin onto the spindle while continuously winding a bobbin on another spindle at very high speed comprising:

a bobbin feed device for feeding bobbins to the spindles;

an ejector device with an ejector shaft for ejecting the full bobbins from the spindles;

a rotatable turret with the spindles secured onto the turret;

a main shaft rotated by energy means for providing continuous speed-power and wherein the main shaft is both controllably coupled to the turret for controlling the rotation of the turret and continuously rotationally driving the spindles;

a control device for controlling the rotation of the turret for positioning the spindles, controlling the ejector shaft for ejecting the full bobbins and controlling turret pen shaft for engaging the turret in a desired position;

a device for programming the control device for the rotation of the turret turn at the preprogrammed interval and controlling the movement of ejector device and bobbin feed device as preprogrammed, also controlling the preprogramming of the number of bobbins wound per minute according to the yards desired on each bobbin.

2. A fully automatic bobbin winding machine according to claim 1, wherein the control device is either controlled by pneumatic or electronic force.

* * * * *